US010203158B2

(12) United States Patent
Xia et al.

(10) Patent No.: US 10,203,158 B2
(45) Date of Patent: Feb. 12, 2019

(54) METHOD AND ARRANGEMENT FOR FEEDING PROCESS GASES FROM A SUSPENSION SMELTING FURNACE INTO A WASTE HEAT BOILER

(71) Applicant: OUTOTEC (FINLAND) OY, Espoo (FI)

(72) Inventors: Jiliang Xia, Pori (FI); Tapio Ahokainen, Helsinki (FI); Risto Saarinen, Espoo (FI)

(73) Assignee: OUTOTEC (FINLAND) OY, Espoo (FI)

( * ) Notice: Subject to any disclaimer, the term of this patent is extended or adjusted under 35 U.S.C. 154(b) by 0 days.

(21) Appl. No.: 15/029,904

(22) PCT Filed: Oct. 23, 2014

(86) PCT No.: PCT/FI2014/050801

§ 371 (c)(1),
(2) Date: Apr. 15, 2016

(87) PCT Pub. No.: WO2015/059361

PCT Pub. Date: Apr. 30, 2015

(65) Prior Publication Data

US 2016/0252305 A1 Sep. 1, 2016

(30) Foreign Application Priority Data

Oct. 25, 2013 (FI) ..... 20136051

(51) Int. Cl.
*F27D 17/00* (2006.01)
*F27B 3/10* (2006.01)

(52) U.S. Cl.
CPC ..... *F27D 17/004* (2013.01); *F27B 3/10* (2013.01); *F27D 17/002* (2013.01); *F27D 2017/006* (2013.01)

(58) Field of Classification Search
CPC ..... F27D 17/004; F27D 17/002
See application file for complete search history.

(56) References Cited

U.S. PATENT DOCUMENTS 2,506,557 A 5/1950 Bryk et al.
5,029,556 A 7/1991 Malmström et al.
(Continued)

FOREIGN PATENT DOCUMENTS

AT 505 750 A4 4/2009
JP 2009-221508 A2 10/2009
WO WO 2007/113375 A1 10/2007

OTHER PUBLICATIONS

International Search Report (PCT/ISA/210) dated Mar. 12, 2015, by the European Patent Office as the International Searching Authority for International Application No. PCT/FI2014/050801.
(Continued)

*Primary Examiner* — Scott R Kastler
(74) *Attorney, Agent, or Firm* — Buchanan, Ingersoll & Rooney PC

(57) ABSTRACT

Provided are a method and an arrangement for feeding process gases from a suspension smelting furnace into a waste heat boiler. The arrangement comprises a feeding throat for feeding process gas. The feeding throat is connected to an uptake inner space at an exit. The feeding throat is connected to the waste heat boiler at an entrance. The feeding throat having a feeding channel comprising a channel inner roof. At least one of an uptake inner roof of the uptake of the suspension smelting furnace and the channel inner roof of the feeding channel of the feeding throat is provided with an angled and/or curved section that slopes at least partly downwardly in an angled and/or curved manner in the direction towards the entrance.

19 Claims, 5 Drawing Sheets

(56) References Cited

U.S. PATENT DOCUMENTS

Figure 1:
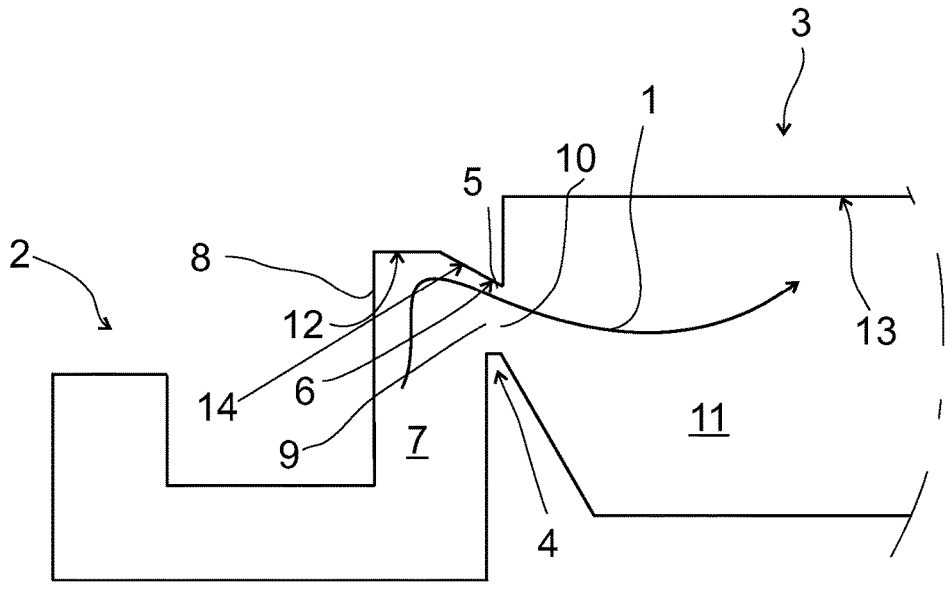

| | | | | |
|---|---|---|---|---|
| 6,180,078 | B1 * | 1/2001 | Poijarvi | C01B 17/503 423/540 |
| 6,797,229 | B2 * | 9/2004 | Saarinen | F27D 25/001 266/135 |
| 2009/0126530 | A1 | 5/2009 | Saarinen | |
| 2011/0038772 | A1 | 2/2011 | Aichinger et al. | |
| 2016/0252305 | A1 * | 9/2016 | Xia | F27B 3/10 266/44 |

OTHER PUBLICATIONS

Written Opinion (PCT/ISA/237) dated Mar. 12, 2015, by the European Patent Office as the International Searching Authority for International Application No. PCT/FI2014/050801.

Notification of Transmittal of the International Preliminary Report on Patentability (PCT/IPEA/416) and International Preliminary Report on Patentability (PCT/IPEA/409) dated Feb. 3, 2016, by the European Patent Office as the International Searching Authority for International Application No. PCT/FI2014/050801.

KR Office Action (Notification of Grounds for Rejection) dated Aug. 29, 2017, by the Korean Patent Office in corresponding Korean Patent Application No. 10-2016-7009928, and an English translation of the Office Action. (12 pgs).

* cited by examiner

METHOD AND ARRANGEMENT FOR FEEDING PROCESS GASES FROM A SUSPENSION SMELTING FURNACE INTO A WASTE HEAT BOILER

FIELD OF THE INVENTION

The invention relates to a method for feeding process gases from an uptake of a suspension smelting furnace into a waste heat boiler as defined in the preamble of independent claim 1.

The invention also relates to an arrangement for feeding process gases from an uptake of a suspension smelting furnace into a waste heat boiler as defined in the preamble of independent claim 11.

It is a well-known problem that the flow of the process gas flowing from the uptake shaft of a suspension smelting furnace into a waste gas boiler is very unequal. The gas velocity in the upper part of the boiler entrance between the feeding throat and the waste heat boiler is much higher than in the lower part where the gas velocity is low or even negative. This causes strong gas and dust impingement to the waste heat boiler inner roof and sidewalls near the entrance. As a result the corrosion rate in those areas of the boiler is much higher than in the other areas. Also at the bottom of the entrance where the gas velocity is low, dust accumulates causes in hard aggregations.

Publication U.S. Pat. No. 5,029,556 relates to a method of improving the heat recovery in a waste head boiler, in which gas, produced in high-temperature processes and containing molten and/or solid particles and/or evaporated components, is cooled. In a waste heat boiler, a slowly cooling zone, i.e. a hot "tongue" is generally formed in the gas flow. To improve the cooling of the hot "tongue", gas and/or solid particles and/or vaporizing liquid, such as circulating gas or circulating particles separated from the process and cooled, are introduced into the hot zone or "tongue".

OBJECTIVE OF THE INVENTION

The object of the invention is to provide a method and an arrangement for feeding process gases from a suspension smelting furnace into a waste heat boiler that causes less wear on the waste heat boiler and that causes less accumulations in the region of the entrance of the waste heat boiler.

SHORT DESCRIPTION OF THE INVENTION

The invention is based on guiding the process gas that is fed from the uptake inner space of the suspension smelting furnace into the boiler inner space of the waste heat boiler downward by providing at least one of an uptake inner roof of the uptake of the suspension smelting furnace and the channel inner roof of the feeding channel of the feeding throat with an angled and/or curved section that slopes at least partly downwardly in an angled and/or curved manner in the direction towards the entrance between the feeding throat and the boiler inner space of the waste heat boiler.

LIST OF FIGURES

Figure 2:
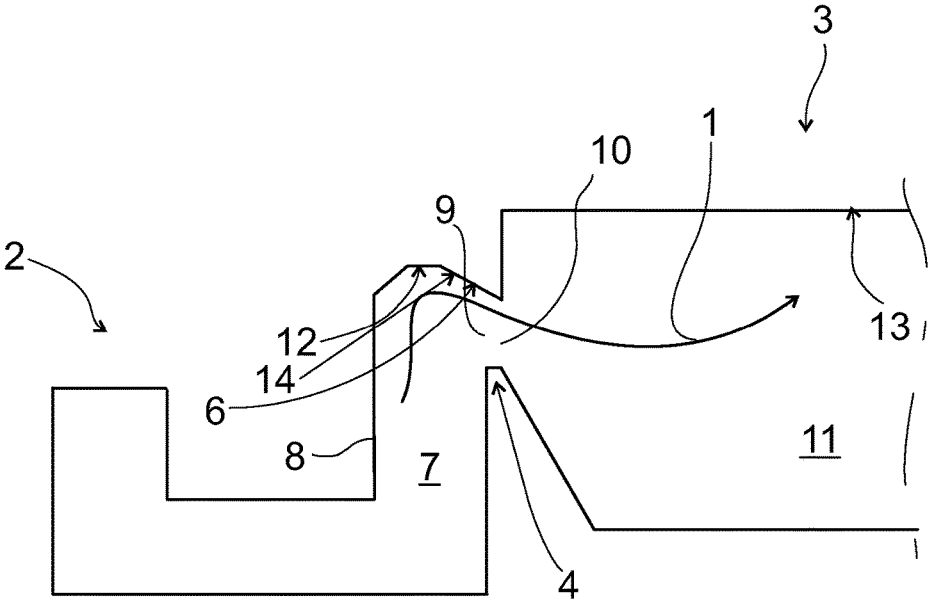
Figure 3:
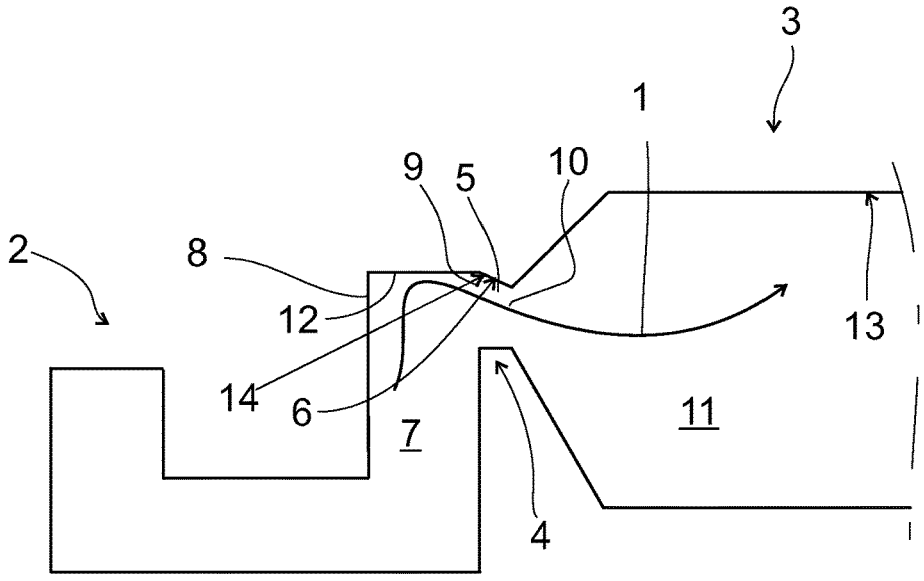
Figure 4:
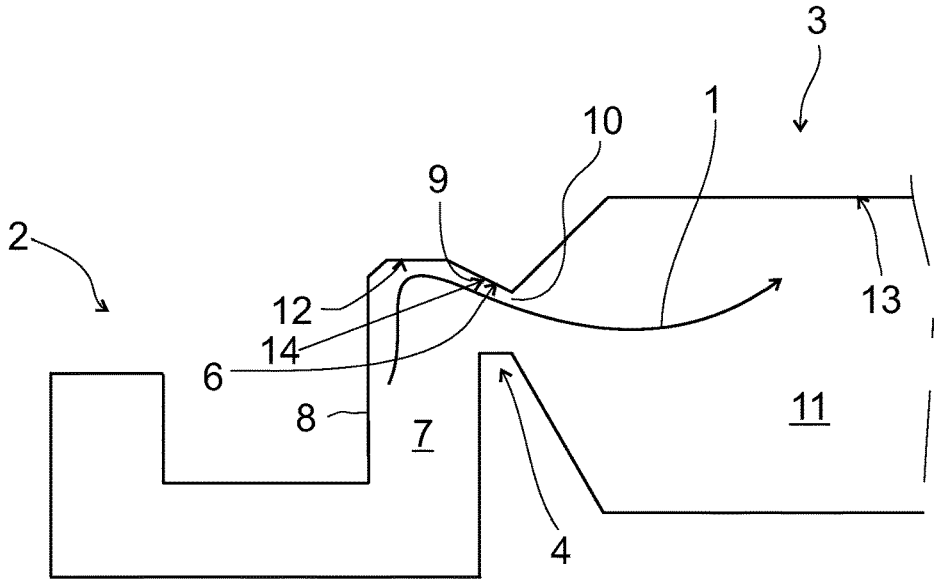
Figure 5:
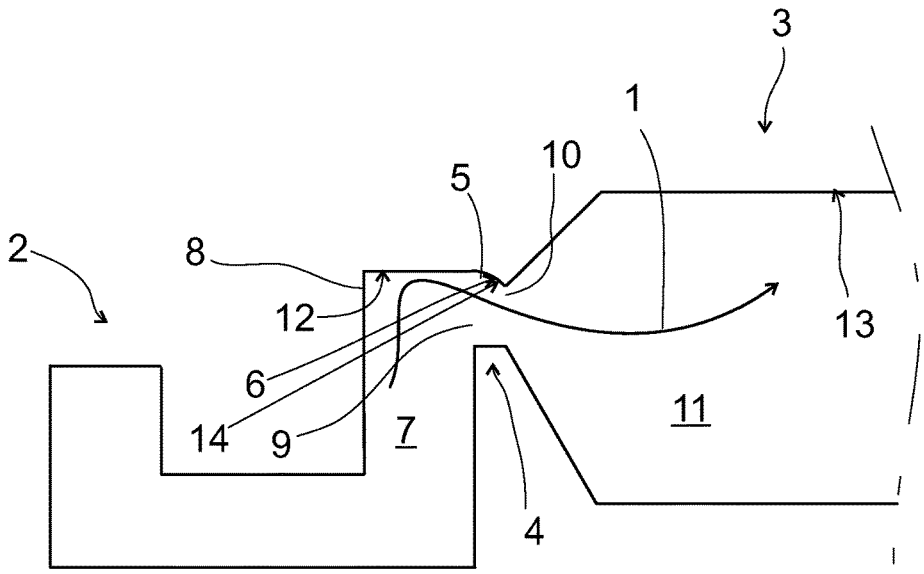
Figure 6:
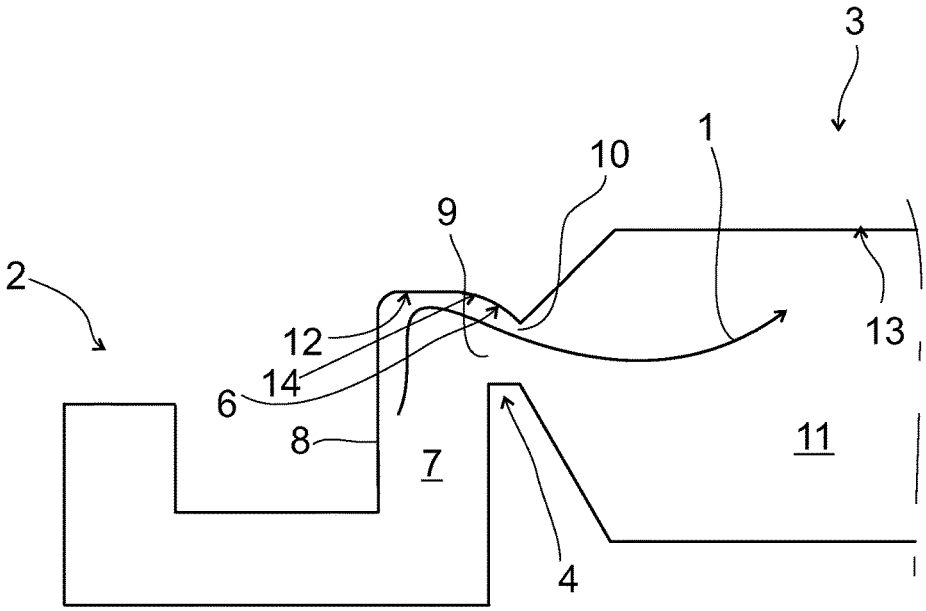
Figure 7:
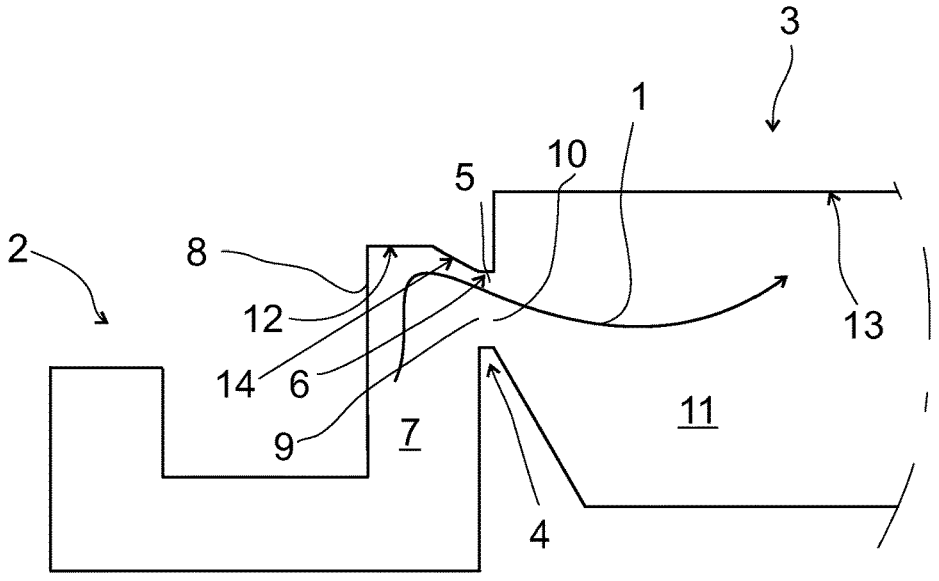
Figure 8:
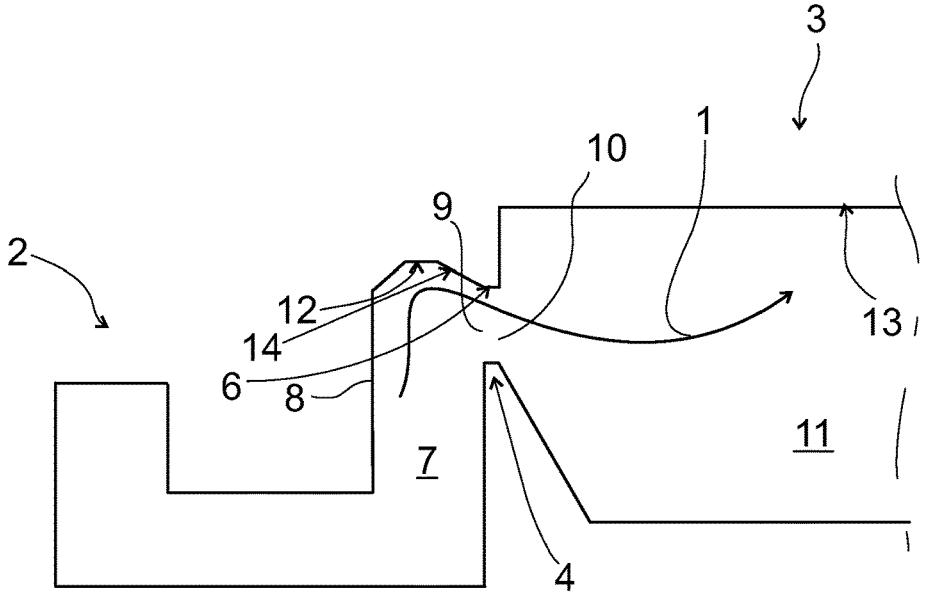
Figure 9:
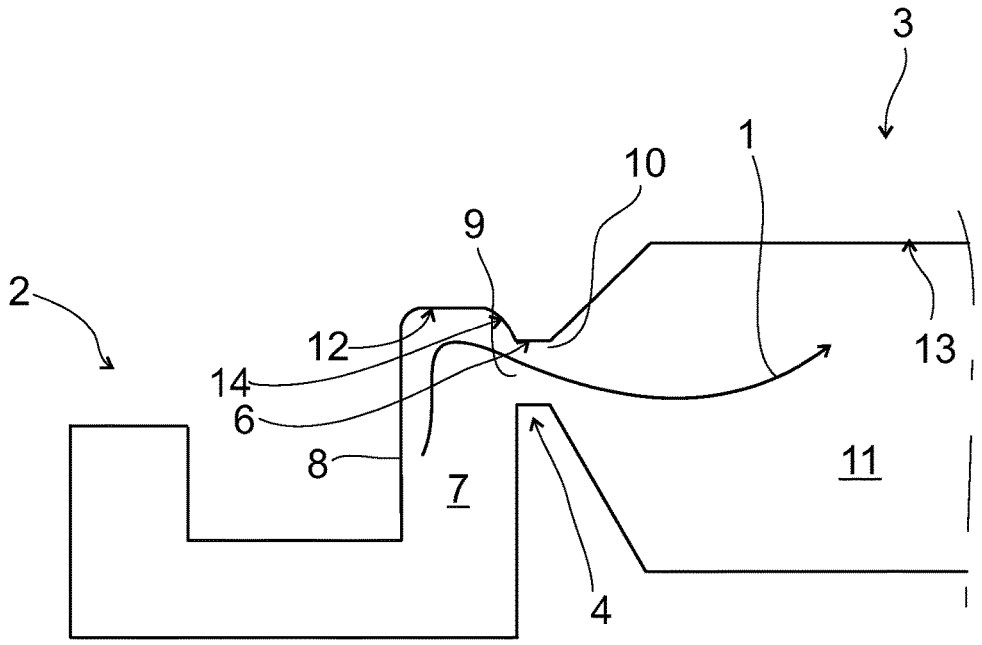

In the following the invention will described in more detail by referring to the figures, which FIG. 1 shows the principle of a first embodiment of the arrangement, FIG. 2 shows the principle of a second embodiment of the arrangement, FIG. 3 shows the principle of a third embodiment of the arrangement, FIG. 4 shows the principle of a fourth embodiment of the arrangement, FIG. 5 shows the principle of a fifth embodiment of the arrangement, FIG. 6 shows the principle of a sixth embodiment of the arrangement, FIG. 7 shows the principle of a seventh embodiment of the arrangement, FIG. 8 shows the principle of a eight embodiment of the arrangement, and FIG. 9 shows the principle of a ninth embodiment of the arrangement.

DETAILED DESCRIPTION OF THE INVENTION

The invention relates to a method and to an arrangement for feeding process gases 1 from an uptake 8 of a suspension smelting furnace 2 into a waste heat boiler 3.

The function principle of a suspension smelting furnace is presented for example in publication U.S. Pat. No. 2,506,557.

First the method and some preferred embodiments and variants thereof will be described in greater detail.

The method comprises a first providing step for providing a feeding throat 4 having a feeding channel 5 comprising a channel inner roof 6.

The method comprises a connecting step for connecting the feeding throat 4 to an uptake inner space 7 of an uptake 8 of the suspension smelting furnace 2 at an exit 9 between the inner space of the uptake 8 of the suspension smelting furnace 2 and the feeding throat 4 and for connecting the feeding throat 4 to the waste heat boiler 3 at an entrance 10 between the feeding throat 4 and a boiler inner space 11 of the waste heat boiler 3.

The method comprises a second providing step for providing at least one of an uptake inner roof 12 of the uptake 8 of the suspension smelting furnace 2 and the channel inner roof 6 of the feeding channel 5 of the feeding throat 4 with an angled and/or curved section 14 that slopes at least partly downwardly in an angled and/or curved manner in the direction towards the entrance 10 between the feeding throat 4 and the boiler inner space 11 of the waste heat boiler 3. In other words, the method comprises a second providing step for providing an uptake inner roof 12 of the uptake 8 of the suspension smelting furnace 2 and/or the channel inner roof 6 of the feeding channel 5 of the feeding throat 4 with an angled and/or curved section 14 that slopes at least partly downwardly in an angled and/or curved manner in the direction towards the entrance 10 between the feeding throat 4 and the boiler inner space 11 of the waste heat boiler 3.

The method comprises a feeding step for feeding process gases 1 from the uptake 8 of the suspension smelting furnace 2 into the waste heat boiler 3 through the feeding channel 5 of the feeding throat 4.

The connecting step may include, as shown in the figures, connecting the feeding throat 4 to the uptake inner space 7 of the uptake 8 of the suspension smelting furnace 2 at the exit 9 between the uptake inner space 7 of the uptake 8 of the suspension smelting furnace 2 and the feeding throat 4 so that the channel inner roof 6 of the feeding channel 5 of the feeding throat 4 adjoins the uptake inner roof 12 of the uptake 8 of the suspension smelting furnace 2. This means that the feeding throat 4 is in the connecting step connected to the uptake inner space 7 of the uptake 8 of the suspension smelting furnace 2 at the exit 9 between the uptake inner space 7 of the uptake 8 of the suspension smelting furnace 2 and the feeding throat 4 so that there is no vertical portions (not shown in the figures) of the uptake inner space 7 of the uptake 8 of the suspension smelting furnace 2 between the uptake inner roof 12 of the uptake 8 of the suspension smelting furnace 2 and the channel inner roof 6 of the feeding channel 5 of the feeding throat 4.

The second providing step may, as in the embodiments shown in FIGS. 1, 2, 4, and 6 to 9, include providing the uptake inner roof 12 of the uptake 8 of the suspension smelting furnace 2 with an angled and/or curved section 14 that slopes at least partly downwardly in an angled and/or curved manner in the direction towards the exit 9 between the uptake inner space 7 of the uptake 8 of the suspension smelting furnace 2 and the feeding throat 4. In these embodiments the connecting step may include connecting the feeding throat 4 to the uptake inner space 7 of the uptake 8 of the suspension smelting furnace 2 at the exit 9 between the uptake inner space 7 of the uptake 8 of the suspension smelting furnace 2 and the feeding throat 4 so that the channel inner roof 6 of the feeding channel 5 of the feeding throat 4 adjoins the angled and/or curved section 14 of the uptake inner roof 12 of the uptake 8 of the suspension smelting furnace 2.

The second providing step and the connecting step may comprise arranging the feeding throat 4 between the uptake inner space 7 of the uptake 8 of the suspension smelting furnace 2 and the boiler inner space 11 of the waste heat boiler 3 so that the channel inner roof 6 of the feeding throat 4 at least partly between the exit 9 and the entrance 10 slopes downwardly in an angled and/or curved manner in the direction towards the boiler inner space 11 of the waste heat boiler 3 to provide said angled and/or curved section 14, as is shown in the embodiments shown FIGS. 1 to 6. In these embodiments the connecting step may include connecting the feeding throat 4 to the uptake inner space 7 of the uptake 8 of the suspension smelting furnace 2 at the exit 9 between the uptake inner space 7 of the uptake 8 of the suspension smelting furnace 2 and the feeding throat 4 so that the angled and/or curved section 14 of the channel inner roof 6 of the feeding channel 5 of the feeding throat 4 adjoins the angled and/or curved section 14 of the uptake inner roof 12 of the uptake 8 of the suspension smelting furnace 2, as is shown in FIGS. 1, 2, 4, and 6.

In the embodiments shown in FIGS. 7 to 9, the channel inner roof 6 of the feeding channel 5 of the feeding throat 4 is essentially horizontal. In these embodiments the connecting step may include connecting the feeding throat 4 to the uptake inner space 7 of the uptake 8 of the suspension smelting furnace 2 at the exit 9 between the uptake inner space 7 of the uptake 8 of the suspension smelting furnace 2 so that the channel inner roof 6 of the feeding channel 5 of the feeding throat 4 adjoins the angled and/or curved section 14 of the uptake inner roof 12 of the uptake 8 of the suspension smelting furnace 2, as is shown in FIGS. 7 to 9.

The second providing step may include providing the uptake inner roof 12 of the uptake 8 of the suspension smelting furnace 8 with at least one of the following configurations to provide said angled and/or curved section 14 that slopes in an angled and/or curved manner in the direction towards the entrance 10 between the feeding throat 4 and the boiler inner space 11 of the waste heat boiler 3: a dome-shaped configuration, a pyramid-shaped configuration, a cone-shaped configuration, a prism shaped configuration, or a truncated cone-shaped configuration.

The first providing step of the method comprising preferably, but not necessarily, providing a feeding throat 4 having a feeding channel 5 limited by a channel inner roof 6, an inner bottom (not marked with a reference numeral) and two opposite inner side walls (not marked with a reference numeral) between the channel inner roof 6 and the inner bottom.

The connecting step comprises preferably, but not necessarily, connecting the feeding throat 4 between the uptake inner space 7 of the uptake 8 of the suspension smelting furnace 2 and the boiler inner space 11 of the waste heat boiler 3 so that the highest point of the uptake inner roof 12 of the uptake 8 of the suspension smelting furnace 2 is located at a level above the highest point of the channel inner roof 6 of the feeding throat 4.

The second providing step and the connecting step comprises preferably, but not necessarily, arranging the feeding throat 4 between the uptake inner space 7 of the uptake 8 of the suspension smelting furnace 2 and the boiler inner space 11 of the waste heat boiler 3 so that the channel inner roof 6 of the feeding throat 4 slopes downwardly in an angled and/or curved manner in the direction towards the boiler inner space 11 of the waste heat boiler 3 between the exit 9 between the uptake inner space 7 of the uptake 8 of the suspension smelting furnace 2 and the feeding throat 4 and the entrance 10 between the feeding throat 4 and the boiler inner space 11 of the waste heat boiler 3 to provide said angled and/or curved section 14.

The connecting step comprises preferably, but not necessarily, connecting the feeding throat 4 between the uptake inner space 7 of the uptake 8 of the suspension smelting furnace 2 and the boiler inner space 11 of the waste heat boiler 3 so that the boiler inner roof 13 of the boiler inner space 11 of the waste heat boiler 3 is at the entrance 10 between the feeding throat 4 and the boiler inner space 11 of the waste heat boiler 3 located at a level above the channel inner roof 6 of the feeding throat 4 at the entrance 10 between the feeding throat 4 and the boiler inner space 11 of the waste heat boiler 3, as is shown for example in FIGS. 1 and 2.

The connecting step includes preferably, but not necessarily, connecting the feeding throat 4 in the connecting step to the uptake inner space 7 of the uptake 8 of the suspension smelting furnace 2 at the exit 9 so that the highest point of the uptake inner roof 12 of the uptake 8 of the suspension smelting furnace 2 is located at a level of 1 to 2 m above the level of the channel inner roof 6 of the feeding throat 4 at the exit 9 between the uptake inner space 7 of the uptake 8 of the suspension smelting furnace 2 and the feeding throat 4.

The second providing step and the connecting step comprises preferably, but not necessarily, arranging the feeding throat 4 between the uptake inner space 7 of the uptake 8 of the suspension smelting furnace 2 and the boiler inner space 11 of the waste heat boiler 3 so that the channel inner roof 6 of the feeding throat 4 slopes downwardly with a sloping angle that is between 30 and 60 degrees, such as 45 degrees.

The second providing step and the connecting step comprises preferably, but not necessarily, arranging the feeding throat 4 between the uptake inner space 7 of the uptake 8 of the suspension smelting furnace 2 and the boiler inner space 11 of the waste heat boiler 3 so that the channel inner roof 6 of the feeding throat 4 at least partly between the exit 9 and the entrance 10 slopes downwardly with a sloping angle that is between 30 and 60 degrees, such as 45 degrees.

Next the arrangement and some preferred embodiments and variants thereof will be described in greater detail.

The arrangement comprises a feeding throat 4 for feeding process gas 1 from an uptake inner space 7 of the uptake 8 of the suspension smelting furnace 2 into the boiler inner space 11 of the waste heat boiler 3.

The feeding throat 4 is connected to an uptake inner space 7 of the uptake 8 of the suspension smelting furnace 2 at an exit 9 between the uptake inner space 7 of the uptake 8 of the suspension smelting furnace 2 and the feeding throat 4.

The feeding throat 4 is connected to the waste heat boiler 3 at an entrance 10 between the feeding throat 4 and a boiler inner space 11 of the waste heat boiler 3.

The feeding throat 4 has a feeding channel 5 comprising a channel inner roof 6.

At least one of an uptake inner roof 12 of the uptake 8 of the suspension smelting furnace 2 and the channel inner roof 6 of the feeding channel 5 of the feeding throat 4 is provided with an angled and/or curved section 14 that slopes at least partly downwardly in an angled and/or curved manner in the direction towards the entrance 10 between the feeding throat 4 and the boiler inner space 11 of the waste heat boiler 3. In other words, an uptake inner roof 12 of the uptake 8 of the suspension smelting furnace 2 or the channel inner roof 6 of the feeding channel 5 of the feeding throat 4 is provided with an angled and/or curved section 14 that slopes at least partly downwardly in an angled and/or curved manner in the direction towards the entrance 10 between the feeding throat 4 and the boiler inner space 11 of the waste heat boiler 3.

The feeding throat 4 may, as shown in the figures, be connected to the uptake inner space 7 of the uptake 8 of the suspension smelting furnace 2 at the exit 9 between the uptake inner space 7 of the uptake 8 of the suspension smelting furnace 2 and the feeding throat 4 so that the channel inner roof 6 of the feeding channel 5 of the feeding throat 4 adjoins the uptake inner roof 12 of the uptake 8 of the suspension smelting furnace 2. This means that the feeding throat 4 is connected to the uptake inner space 7 of the uptake 8 of the suspension smelting furnace 2 at the exit 9 between the uptake inner space 7 of the uptake 8 of the suspension smelting furnace 2 and the feeding throat 4 so that there is no vertical portions (not shown in the figures) of the uptake inner space 7 of the uptake 8 of the suspension smelting furnace 2 between the uptake inner roof 12 of the uptake 8 of the suspension smelting furnace 2 and the channel inner roof 6 of the feeding channel 5 of the feeding throat 4.

The uptake inner roof 12 of the uptake 8 of the suspension smelting furnace 2 may, as in the embodiments shown FIGS. 1, 2, 4, and 6 to 9, be provided with an angled and/or curved section 14 that slopes at least partly downwardly in an angled and/or curved manner in the direction towards the exit 9 between the uptake inner space 7 of the uptake 8 of the suspension smelting furnace 2 and the feeding throat 4. In these embodiments the feeding throat 4 is preferably, but not necessarily, connected to the uptake inner space 7 of the uptake 8 of the suspension smelting furnace 2 at the exit 9 between the uptake inner space 7 of the uptake 8 of the suspension smelting furnace 2 and the feeding throat 4 so that the channel inner roof 6 of the feeding channel 5 of the feeding throat 4 adjoins the angled and/or curved section 14 of the uptake inner roof 12 of the uptake 8 of the suspension smelting furnace 2.

The channel inner roof 6 of the feeding throat 4 is preferably, but not necessarily, as shown in the embodiments shown FIGS. 1 to 6, provided with an angled and/or curved section 14 that slopes at least partly downwardly in an angled and/or curved manner in the direction towards the entrance 10 between the feeding throat 4 and the boiler inner space 11 of the waste heat boiler 3. In these embodiments the feeding throat 4 may be connected to the uptake inner space 7 of the uptake 8 of the suspension smelting furnace 2 at the exit 9 between the uptake inner space 7 of the uptake 8 of the suspension smelting furnace 2 and the feeding throat 4 so that the angled and/or curved section 14 of the channel inner roof 6 of the feeding channel 5 of the feeding throat 4 adjoins the angled and/or curved section 14 of the uptake inner roof 12 of the uptake 8 of the suspension smelting furnace 2, as is shown in FIGS. 1, 2, 4, and 6.

In the embodiments shown in FIGS. 7 to 9, the channel inner roof 6 of the feeding throat 4 is essentially horizontal. In these embodiments the feeding throat 4 is preferably, but not necessarily, connected to the uptake inner space 7 of the uptake 8 of the suspension smelting furnace 2 at the exit 9 between the uptake inner space 7 of the uptake 8 of the suspension smelting furnace 2 and the feeding throat 4 so that the channel inner roof 6 of the feeding channel 5 of the feeding throat 4 adjoins the angled and/or curved section 14 of the uptake inner roof 12 of the uptake 8 of the suspension smelting furnace 2, as is shown in FIGS. 7 to 9.

The feeding throat 4 has preferably, but not necessarily, a feeding channel 5 limited by the channel inner roof 6, an inner bottom (not marked with a reference numeral) and two opposite inner side walls (not marked with a reference numeral) between the channel inner roof 6 and the inner bottom.

The highest point of the uptake inner roof 12 of the uptake 8 of the suspension smelting furnace 2 is preferably, but not necessarily, located at a level above the highest point of the channel inner roof 6 of the feeding throat 4.

The channel inner roof 6 of the feeding throat 4 between the exit 9 between the uptake inner space 7 of the uptake 8 of the suspension smelting furnace 2 and the feeding throat 4 and the entrance 10 between the feeding throat 4 and the boiler inner space 11 of the waste heat boiler 3 is preferably, but not necessarily, provided with an angled and/or curved section 14 that slopes downwardly in an angled and/or curved manner in the direction towards the entrance 10 between the feeding throat 4 and the boiler inner space 11 of the waste heat boiler 3.

The boiler inner roof 13 of the boiler inner space 11 of the waste heat boiler 3 is preferably, but not necessarily, at the entrance 10 between the feeding throat 4 and the boiler inner space 11 of the waste heat boiler 3 located at a level above the channel inner roof 6 of the feeding throat 4 at the entrance 10 between the feeding throat 4 and the boiler inner space 11 of the waste heat boiler 3, as is shown for example in FIGS. 1 and 2.

The highest point of the uptake inner roof 12 of the uptake 8 of the suspension smelting furnace 2 is preferably, but not necessarily, located at a level of 1 to 2 m above the level of the channel inner roof 6 of the feeding throat 4 at the exit 9 between the uptake inner space 7 of the uptake 8 of the suspension smelting furnace 2 and the feeding throat 4.

The channel inner roof 6 of the feeding throat 4 slopes preferably, but not necessarily, downwardly with a sloping angle that is between 30 and 60 degrees, such as 45 degrees.

The channel inner roof 6 of the feeding throat 4 at least partly between the exit 9 and the entrance 10 slopes preferably, but not necessarily, downwardly with a sloping angle that is between 30 and 60 degrees, such as 45 degrees.

It is apparent to a person skilled in the art that as technology advances, the basic idea of the invention can be implemented in various ways. The invention and its embodiments are therefore not restricted to the above examples, but they may vary within the scope of the claims.

The invention claimed is:

1. A method for feeding process gases from an uptake of a suspension smelting furnace into a waste heat boiler, said uptake comprising an uptake inner roof, said uptake inner roof being non-vertical, wherein the method comprises a first providing step for providing a feeding throat having a feeding channel comprising a channel inner roof, said channel inner roof being non-vertical, a connecting step for connecting the feeding throat to an uptake inner space of the uptake of the suspension smelting furnace at an exit between the uptake inner space of the uptake of the suspension smelting furnace and the feeding throat and for connecting the feeding throat to the waste heat boiler at an entrance between the feeding throat and a boiler inner space of the waste heat boiler, a feeding step for feeding process gases from the uptake of the suspension smelting furnace into the waste heat boiler through the feeding channel of the feeding throat, and a second providing step for providing at least one of the uptake inner roof of the uptake of the suspension smelting furnace and the channel inner roof of the feeding channel of the feeding throat with an angled and/or curved section that slopes at least partly downwardly in an angled and/or curved manner in the direction towards the entrance between the feeding throat and the boiler inner space of the waste heat boiler, wherein the connecting step includes connecting the feeding throat to the uptake inner space of the uptake of the suspension smelting furnace at the exit between the uptake inner space of the uptake of the suspension smelting furnace and the feeding throat so that the channel inner roof of the feeding channel of the feeding throat adjoins the uptake inner roof of the uptake of the suspension smelting furnace.

2. The method according to claim 1, wherein the second providing step includes providing the uptake inner roof of the uptake of the suspension smelting furnace with an angled and/or curved section that slopes at least partly downwardly in an angled and/or curved manner in the direction towards the exit between the uptake inner space of the uptake of the suspension smelting furnace and the feeding throat.

3. The method according to claim 1, wherein the second providing step and the connecting step include arranging the feeding throat between the uptake inner space of the uptake of the suspension smelting furnace and the boiler inner space of the waste heat boiler so that the channel inner roof of the feeding throat at least partly between the exit and the entrance slopes downwardly in an angled and/or curved manner in the direction towards the boiler inner space of the waste heat boiler to provide said angled and/or curved section.

4. The method according to claim 1, wherein the first providing step for providing a feeding throat comprises providing a feeding throat having a feeding channel limited by the channel inner roof, an inner bottom and two opposite inner side walls between the channel inner roof and the inner bottom.

5. The method according to claim 1, wherein the connecting step includes connecting the feeding throat between the uptake inner space of the uptake of the suspension smelting furnace and the boiler inner space of the waste heat boiler so that the highest point of the uptake inner roof of the uptake of the suspension smelting furnace is located at a level above the highest point of the channel inner roof of the feeding throat.

6. The method according to claim 1, wherein the connecting step and the second providing step include arranging the feeding throat between the uptake inner space of the uptake of the suspension smelting furnace and the boiler inner space of the waste heat boiler so that the channel inner roof of the feeding throat slopes downwardly in an angled and/or curved manner in the direction towards the boiler inner space of the waste heat boiler between the exit between the uptake inner space of the uptake of the suspension smelting furnace and the feeding throat and the entrance between the feeding throat and the boiler inner space of the waste heat boiler to provide said angled and/or curved section.

7. The method according to claim 1, wherein the connecting step includes connecting the feeding throat between the uptake inner space of the uptake of the suspension smelting furnace and the boiler inner space of the waste heat boiler so that the boiler inner roof of the boiler inner space of the waste heat boiler is at the entrance between the feeding throat and the boiler inner space of the waste heat boiler located at a level above the channel inner roof of the feeding throat at the entrance between the feeding throat and the boiler inner space of the waste heat boiler.

8. The method according to claim 1, wherein the connecting step includes connecting the feeding throat to the boiler inner space of the uptake of the suspension smelting furnace at the exit so that the highest point of the uptake inner roof of the uptake of the suspension smelting furnace is located at a level of 1 to 2 m above the level of the channel inner roof of the feeding throat at the exit between the uptake inner space of the uptake of the suspension smelting furnace and the feeding throat.

9. The method according to claim 1, wherein the connecting step and the second providing step include arranging the feeding throat between the uptake inner space of the uptake of the suspension smelting furnace and the boiler inner space of the waste heat boiler so that the channel inner roof of the feeding throat at least partly between the exit and the entrance slopes downwardly with a sloping angle that is between 30 and 60 degrees, such as 45 degrees.

10. An arrangement for feeding process gases from an uptake of a suspension smelting furnace into a waste heat boiler, said uptake comprising an uptake inner roof, said uptake inner roof being non-vertical, wherein the arrangement comprises a feeding throat for feeding process gas from an uptake inner space of the uptake of the suspension smelting furnace into the boiler inner space of the waste heat boiler, wherein the feeding throat is connected to the uptake inner space of the uptake of the suspension smelting furnace at an exit between the uptake inner space of the uptake of the suspension smelting furnace and the feeding throat, wherein the feeding throat is connected to the waste heat boiler at an entrance between the feeding throat and a boiler inner space of the waste heat boiler, wherein the feeding throat has a feeding channel comprising a channel inner roof, said channel inner roof being non-vertical, wherein at least one of the uptake inner roof of the uptake of the suspension smelting furnace and the channel inner roof of the feeding channel of the feeding throat being provided with an angled and/or curved section that slopes at least partly downwardly in an angled and/or curved manner in the direction towards the entrance between the feeding throat and the boiler inner space of the waste heat boiler, and wherein the feeding throat is connected to the uptake inner space of the uptake of the suspension smelting furnace at the exit between the uptake inner space of the uptake of the suspension smelting furnace and the feeding throat so that the channel inner roof of the feeding channel of the feeding throat adjoins the uptake inner roof of the uptake of the suspension smelting furnace.

11. The arrangement according to claim 10, wherein the uptake inner roof of the uptake of the suspension smelting furnace is provided with an angled and/or curved section that slopes at least partly downwardly in an angled and/or curved manner in the direction towards the exit between the uptake inner space of the uptake of the suspension smelting furnace and the feeding throat.

12. The arrangement according to claim 10, wherein the channel inner roof of the feeding throat is provided with an angled and/or curved section that slopes at least partly downwardly in an angled and/or curved manner in the direction towards the entrance between the feeding throat and the boiler inner space of the waste heat boiler.

13. The arrangement according to 10, wherein the feeding throat having a feeding channel is limited by the channel inner roof, an inner bottom and two opposite inner side walls between the channel inner roof and the inner bottom.

14. The arrangement according to claim 10, wherein the highest point of the uptake inner roof of the uptake of the suspension smelting furnace is located at a level above the highest point of the channel inner roof of the feeding throat.

15. The arrangement according to claim 10, wherein the channel inner roof of the feeding throat between the exit between the uptake inner space of the uptake of the suspension smelting furnace and the feeding throat and the entrance between the feeding throat and the boiler inner space of the waste heat boiler is provided with an angled and/or curved section that slopes downwardly in an angled and/or curved manner in the direction towards the entrance between the feeding throat and the boiler inner space of the waste heat boiler.

16. The arrangement according to claim 10, wherein the boiler inner roof of the boiler inner space of the waste heat boiler is at the entrance between the feeding throat and the boiler inner space of the waste heat boiler located at a level above the channel inner roof of the feeding throat at the entrance between the feeding throat and the boiler inner space of the waste heat boiler.

17. The arrangement according to claim 10, wherein the highest point of the uptake inner roof of the uptake of the suspension smelting furnace is located at a level of 1 to 2 m above the level of the channel inner roof of the feeding throat at the exit between the uptake inner space of the uptake of the suspension smelting furnace and the feeding throat.

18. The arrangement according to claim 10, wherein the channel inner roof of the feeding throat at least partly between the exit and the entrance slopes downwardly with a sloping angle that is between 30 and 60 degrees.

19. The arrangement according to claim 10, wherein the channel inner roof of the feeding throat at least partly between the exit and the entrance slopes downwardly with a sloping angle that is 45 degrees.

* * * * *